United States Patent [19]

Asami

[11] 4,058,954

[45] Nov. 22, 1977

[54] COIN PACKAGING MACHINE

[75] Inventor: Kazuto Asami, Himeji, Japan

[73] Assignee: Glory Kogyo Kabushiki Kaisha, Japan

[21] Appl. No.: 731,823

[22] Filed: Oct. 12, 1976

[51] Int. Cl.[2] ..... B65B 57/14; B65B 57/20; B65B 11/04

[52] U.S. Cl. ..... 53/54; 53/59 R; 53/212

[58] Field of Search ..... 53/54, 59 R, 212

[56] References Cited

U.S. PATENT DOCUMENTS 3,469,365 9/1969 Uchida et al. ..... 53/54

*Primary Examiner*—Travis S. McGehee

*Attorney, Agent, or Firm*—Wenderoth, Lind & Ponack

[57] ABSTRACT

A machine for packaging a predetermined number of coins has a coin feeding device, a coin counting device for counting coins, a coin packaging device for stacking and packaging coins fed by the coin feeding device, a control system for controlling the above described devices, a detecting device for detecting whether the stacking or packaging of the coins is acceptable or not and for producing a detection signal when unacceptable packaging is detected, a rejecting device for rejecting a package of coins detected as unacceptable from the coin packaging device, and a restart commanding system for applying the restart command signal to the control system when the production of the detection signal ceases after the coins are rejected, whereby the next packaging operation is started.

3 Claims, 12 Drawing Figures

40
n1 n2 n3 n4
44
K2
K1
K3
K9
CAM
41
42(42A~42C)
52
COINCIDENT DETECTION
OPERATION CONTROL INPUT MEANS
75
46(46A~46C)
K4
K5
K7
K6
K8
50
53
48
CLUTCH
DDC
MAIN CONTROL CIRCUIT
M5
76
77
M4
M1
78
CONTROL DEVICE
M2
36
81
80
KDC
M3
79
PACKAGING CONTROL DEVICE
M6
37
83
82
HDC
a
b
c
d
e
f
g
h
i
j
k
l
m

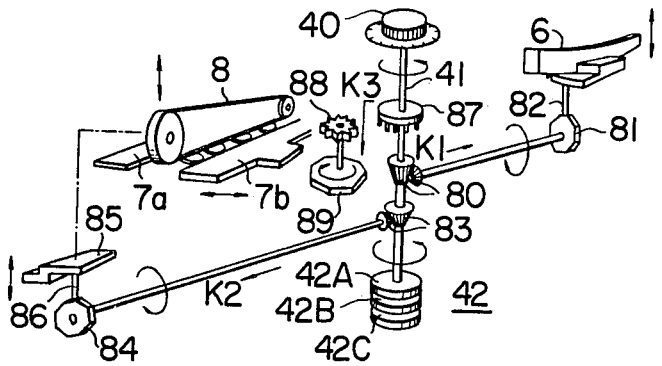
FIG. 2
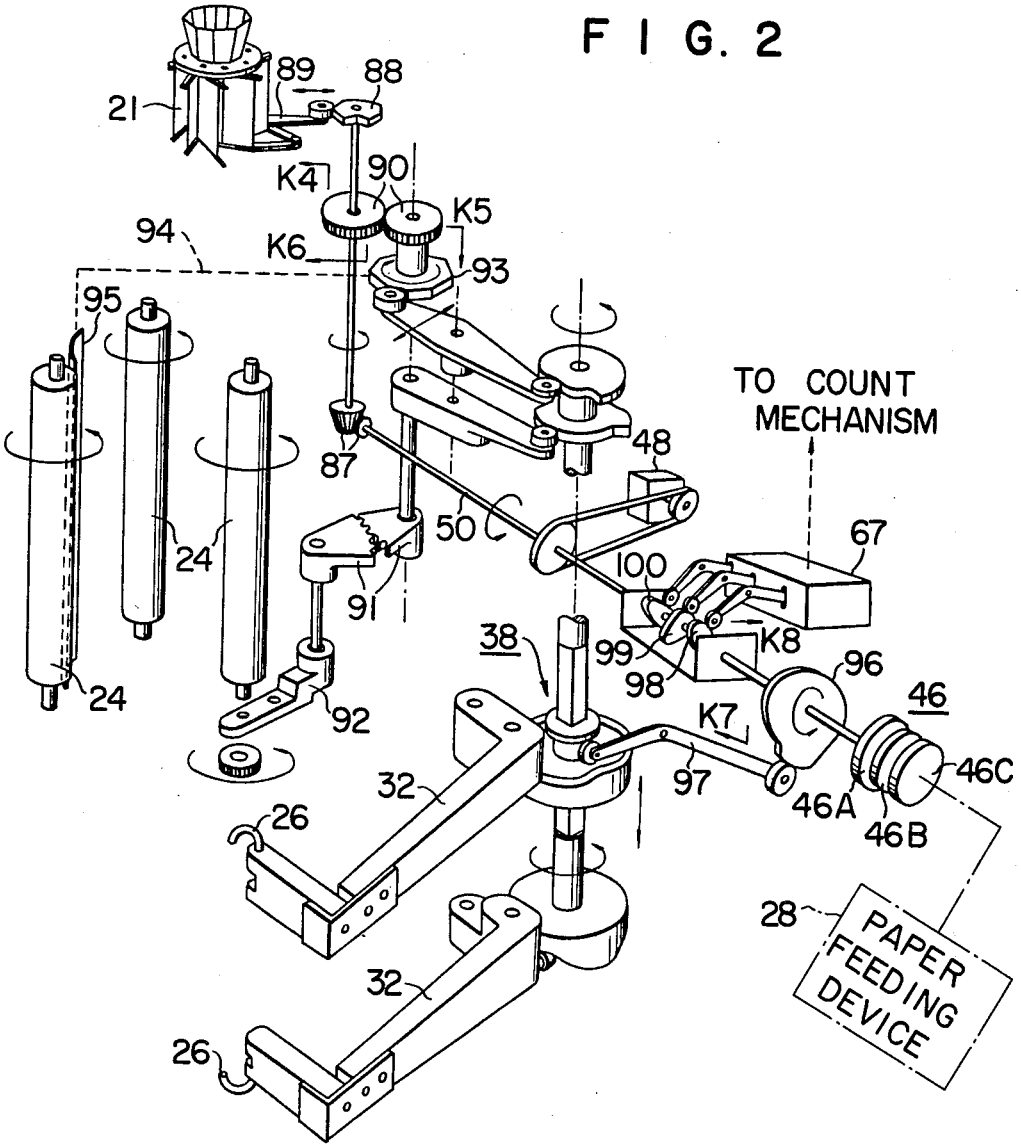

STW
RWH
M6(37)
INR
PUS
AD4
AD5
NO11
I22
NO13
FF3
R3
R2
NO14
C15
PG1
SW5
SW6
I20
C13
C14
I21
STH
SW7
NO15
ALB
NO17
NO16
FF4
I23
AD6
TM1
NO19
SX6
WRC
STL
NO12
AD7
TM2
NO18
I24
ALL
EX4
ALA
I28
STP
TMR
ND19
NO20
I27
R4
R5
I29
C16
PG2
I30
I31
CLE
SW8
I25
R6
MM2
PB2
C17
C18
I26
C19
ND18
CLW
CLR
NO21
R7
C20
FF5
SHT
NO22
MM3
TUB
SWS
WRH
I47
SDS
AD17
NO23
I34
NO20
I48
SW9
C21
C22
I32
ND21
I44
NO24
ND23
M5(76)
AD18
ND22
I45
I33
C23
I46
DDC
SW10
C25
KX3
I36
I35
EX1
I41
ND24
ND25
AD8
I49
X3
SET
RES
I37
EX2
I42
C26
I43
NO25
SCS
K42A
K42B
K42C
42
C24
I38
I39
EX3
MSA
C27
C28
C29
I40
MSB
HSC
52
R8
C30
K46A
K46B
K46C
46
I50
MM4
NO28
I51
SND
NO26
FF6
NO27

COIN PACKAGING MACHINE

BACKGROUND OF THE INVENTION

This invention relates to coin packaging machines for packaging a predetermined number of coins separately according to the denominations thereof.

Conventional coin packaging machines of this type have mechanically intricate mechanism and handle coins of many, different denominations. Therefore, the conventional coin packaging machines are liable to encounter a variety of troubles. Whenever such trouble occurs, the machine must be stopped to overcome such trouble, which leads to a decrease of the coin packaging efficiency thereof.

Accordingly, there has been a strong demand for the provision of a coin packaging machine which is so designed that even if such trouble occurs therein, it is unnecessary to suspend the operation of the machine, that is, the coin packaging operation is continuously carried out in such a manner that coins handled when the trouble has occurred are automatically rejected, and the succeeding coin packaging operation is automatically started.

SUMMARY OF THE INVENTION

Accordingly, an object of this invention is to provide a coin packaging machine which satisfies the above-described demand.

More specifically, an object of the invention is to provide a coin packaging machine in which even if trouble occurs, it is unnecessary to suspend the operation thereof, that is, the coin packaing operation is continuously carried out in such a manner that coins handled when the trouble has occurred are rejected, and the succeeding coin packaging operation is automatically started.

The foregoing object and other objects of this invention have been achieved by the provision of a coin packaging machine for packaging a predetermined number of coins separately according to denominations thereof which comprises: coin feeding means for feeding coins to be packaged; coin counting means for counting the number of coins fed by said coin feeding means and for producing, when the number of coins counted coincides with a predetermined number, a coincidence signal; coin packaging means for stacking coins fed by said coin feeding means until the coincidence signal is produced, and for packaging a stack of coins with packaging paper; control means for controlling said coin feeding means, coin counting means, and coin packaging means; abnormality detecting means for detecting whether the stacking or packaging of coins is normal or abnormal, and for producing an abnormality signal when the stacking or packaging of the coins is detected as being abnormal; rejecting means operated by said abnormality detecting means to reject coins stacked abnormally or coins involved in a packaging error from said coin packaging means; and restart commanding means which when the production of said abnormality signal has ceased after the operation of said rejecting means, applies a restart command signal to said control means in order to continue a packaging cycle, whereby after said coins stacked abnormally or said coins involved in a packaging error have been rejected, the succeeding packaging operation is automatically started.

The nature, utility and principle of the invention will become apparent from the following description and the appended claims when read in conjunction with the accompanying drawings, in which like parts are designated by like reference characters.

BRIEF DESCRIPTION OF THE DRAWINGS

In the accompanying drawings

FIG. 2 is an explanatory diagram showing essential parts of the coin packaging machine;

DETAILED DESCRIPTION OF THE INVENTION

Figure 1A:
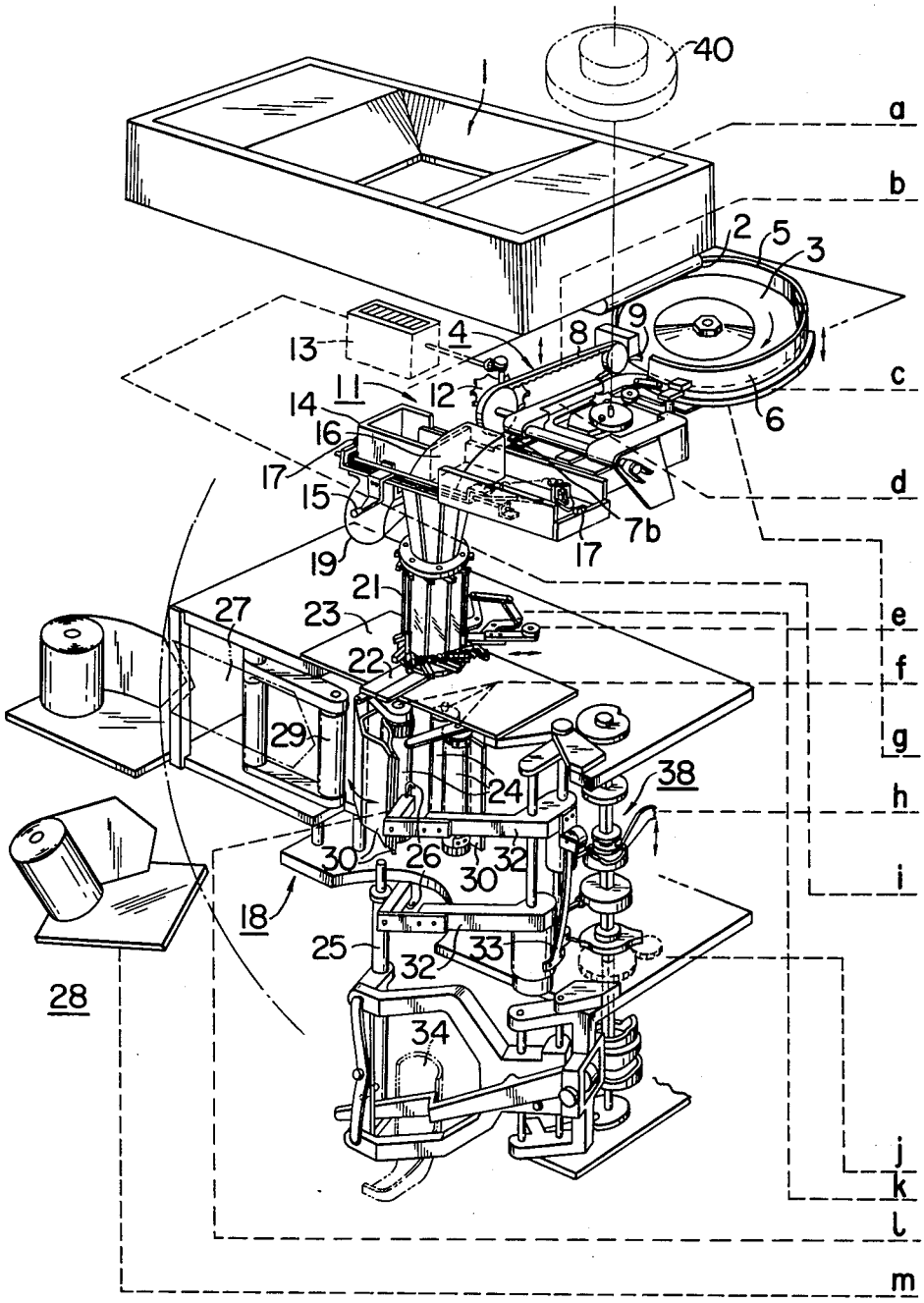
FIGS. 1A and 1B are two parts of a diagram illustrating the mechanism of a coin packaging machine according to this invention.
Figure 1B:
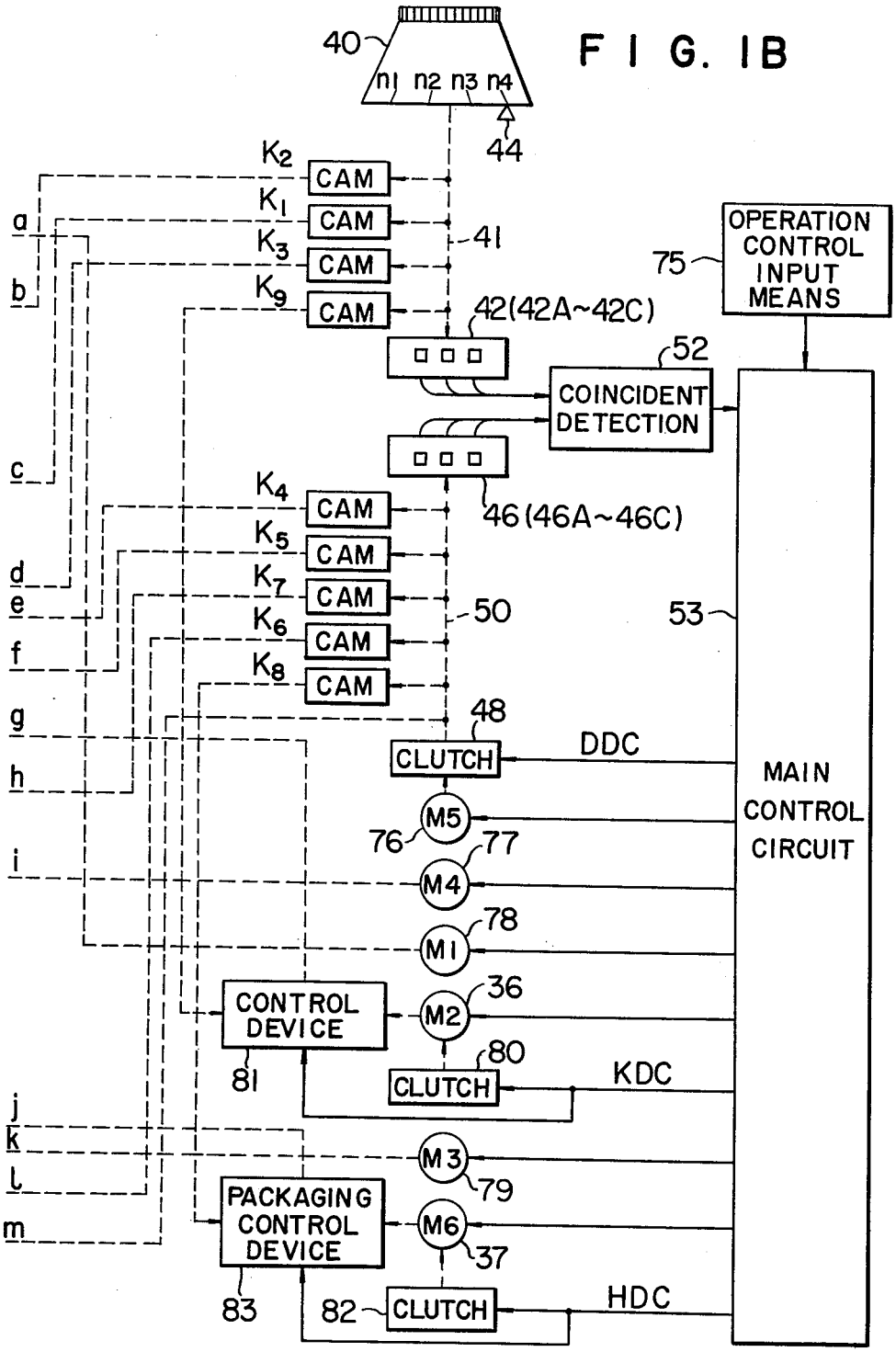

A coin packaging machine to which this invention can be applied, as shown in FIGS. 1A, 1B and 2, comprises a packaging mechanism and a counting mechanism for introducing a predetermined number of coins into the packaging mechanism.

In this machine, coins to be packaged are introduced by means of a belt conveyor 2 onto a rotary disk 3 from a hopper 1 forming the receiving section of the counting mechanism. The coins thus introduced are aligned on the circumferential part of the rotary disk 3 by centrifugal force. The coins thus aligned are successively, or one by one, introduced into a coin path 4. A stationary side wall 5 is provided so as to occupy approximately a half of the circumference of the rotary disk 3. A thickness control plate 6 is provided ahead of the coin path 4 and adjacent to one end of the side wall 5 so that there is provided a gap between the thickness control plate 6 and the upper surface of the rotary disk 3, the gap corresponding to the thickness of one coin. Thus, the coins are lined up and delivered toward the coin path 4 one by one.

More specifically, the thickness control plate 6 is provided on the inner surface of a cover (not shown) which covers the rotary disk 3 and the area around it in such a manner that the plate 6 is vertically movable. The thickness control plate 6 is pressed toward the rotary disk 3 by a spring, but the vertical position of the thickness control plate 6 can be controlled by movement against the elasticity of the spring by a height control means (not shown) confronting the lower surface of the rotary disk 3.

The coin path 4 is made up of a stationary guide plate **7*a* and a movable guide plate 7*b* each having an "L"-shaped section, and a rake-out belt 8 extending between the two guide plates 7*a* and 7*b*. The guide plates 7*a* and 7*b* extend horizontally along the belt 8**, confronting each other.

The coins, being caught by the guide plates **7*a* and 7*b* and the belt 8, are raked out one by one. The guide plate 7*b* can be moved in the direction of its width. Coins having diameters smaller than the distance between the guide plates 7*a* and 7*b* are selectively rejected through the gap therebetween. A fixed pawl 9 is provided at the entrance of the coin path 4 to receive the coins arranged in a line on the rotary disk 3. The end portion, near the rotary disk 3, of the movable guide plate 7***b* is opposed to the fixed pawl 9 so as to provide a gate therebetween. Accordingly, coins having diameters larger than the width of the gate cannot be taken into the coin path 4.

A counting section 11 is provided on the side of the exit of the coin path 4. The star-wheel 12 of the counting section is turned by coins raked out of the coin path 4, whereby whenevever a coin is raked out a count signal is introduced into a counter 13 to count the number of coins.

A coin passed through the counting section 11 is fed into a mode change-over section 14 which comprises a change-over mechanism 16 (slidable right and left) for changing over the path of coins with a change-over knob 15, and a mode change-over switch 17 for providing an electrical mode change-over signal corresponding to a change-over position of the change-over mechanism 16. When the change-over mechanism 16 is switched over to a packaging mode position, coins are delivered to a packaging section 18 which is a part of the packaging mechanism, but when the change-over mechanism 16 is switched over to a count mode position, coins are fed to a counted-coin discharging outlet 19.

The packaging section 18 comprises: a coin stacking mechanism 23 having a stacking cylinder 21, a shutter 22, and a vibrating mechanism; three packaging rolls 24 with a drive mechanism; a guide rod 25 with a drive mechanism; and crimping hooks 26 with a drive mechanism.

The stacking cylinder 21 is a polygonal cylinder formed by arranging a plurality of plate members in overlapping relation to each other. The coins successively passed through the change-over mechanism 16 are stacked on the shutter 22, which is adapted to openably close the lower end of the stacking cylinder 21, one by one with the aid of vibration of the vibrating mechanism. When the plate members of the stacking cylinder 21 are driven, they are moved radially inwardly or outwardly so that the inside diameter of the stacking cylinder is adjusted so as to be slightly larger than the outside diameter of the coins.

When a predetermined number of coins have been stacked in the stacking cylinder 21, the coins thus stacked are brought between the packaging rolls 24 immediately below the stacking cylinder 21 by the guide rod 25. The guide rod 25 is raised along the axis of the stacking cylinder 21 to the position of the shutt4er, and when the shutter 22 is opened the stacked coins are loaded on the top of the guide roller 25, and then the guide roller 25 is moved downward.

The three packaging rolls 24 are arranged symmetrically with respect to the axis of the stacking cylinder 21; two of the rolls 24 in front of the axis of the stacking cylinder 21, and the third one at the rear of the same. These rolls 24 are so designed as to approach one another and to move away from one another keeping this symmetrical condition at all times. Thus, the rolls 24 rotate the stacked coins moved downward by the guide rod 25 by contacting the side surface of the stack of stacked coins. In this example, the rolls 24 have three positions: a standby position where the rolls are remote from the axis of the stacking cylinder, a first position where they approach the side surface of the stack of stacked coins, and a second position where they rotate the stacked coins by contacting the side surface of the stack thereof. While the guide rod 25 guides the stacked coins downward, the rolls advance to the first position so as to keep the stacked coins as they are, and further advance to the second position so as to wrap the stacked coins with packaging paper.

When the packaging rollers 24 have moved to the second position, packaging paper 27 corresponding to a monetary denomination preselected is introduced through paper feeding rolls 29 from a paper feeding device 28. The packaging paper 27 thus introduced is guided by packaging paper guide plates 30 extended between the packaging rolls 24, and is conveyed between the packaging rollers 24 and the stacked coins. Finally, the packaging paper 27 is wrapped on the stack of coins.

When the paper wrapping operation has been achieved, the packaging paper guide plate 30 between the two rolls 24 positioned in front of the axis of the stacking cylinder are moved forward to move away from the position between the two rolls 24. On the other hand, the other packaging paper guide plates 30 are so designed as to move forward and backward together with the three rolls 24.

The crimping hooks 26 are connected to the ends of a pair of arms 32 which are vertically spaced from each other. Upon completion of the packaging sheet wrapping operation, the arms 32 are moved backward. As a result, the crimping hooks 26 are moved toward the axis through the space between the rolls 24, whereby both lateral edge portions of the packaging paper 27 are folded inwardly. Thereafter, the arms 32 are vertically shifted so as to approach each other, as a result of which the folded lateral edge portions are crimped. After this operation, the arms 32 are moved forward to return to their original positions. A spring 33 is interposed between the arms 32 so that the arms are biased toward each other.

After the packaging of the stack of coins is thus completed, the packaging rolls 24 return to the standby position, and the guide rod 25 is moved outwardly, whereby the package of coins drops into a packaged coin discharging outlet 34.

The conveyer 2 between the hopper 1 and the rotary disk 3 is driven by a coin feeding motor 78 (M1). The rotary disk 3 is driven by a rotary disk motor 36(M2), and drives the belt 8 through a clutch 80 and rake-out belt control device 81. The stacking cylinder 21 is driven by a vibrating motor 79 (M3). The counter 13 is reset by a clear motor 77 (M4). The paper feeding device 28 is moved through a clutch 48 by a paper feeding motor 76 (M5). The moved position of the paper feeding device 28 thus moved is detected by cam switch means 46 comprising three cam switches 46A, 46B and 46C. The diameter of the stacking cylinder 21 is set by a cylinder diameter setting cam K4 mounted on the rotary shaft 50. The position of the packaging rolls 24 is set by a roll position setting cam K5 in correspondence to a preselected coin denomination. Furthermore, the degree of opening of the packaging paper guide plates 30 is set by a guide roll setting cam K6 in correspondence to the preselected coin denomination, and the range of shifting of the crimping hooks 26 is set by a crimping hook setting cam K7.

On the other hand, a packaging motor 37(M6) drives a packaging control device 83 through a speed change cam K8 and a clutch 82 provided on the rotary shaft 50, thereby to turn a train of packaging cams. Thus, the opening and closing operation of the shutter 22, the operation of the packaging rolls 24, the opening and closing operation of the packaging paper guide plates 30, the vertical movement and turning operation of the guide rod 25, and the shifting and turning operations of the arms 32 with the crimping hooks are synchronously carried out.

When packaging coins of different denominations, since these coins have different diameters and thicknesses, it is necessary to preset, according to the denomination of coins and the number of the coins, the distance between the rotary disk 3 and the lower surface of the thickness control plate 6, the width of the coin path 4, the height of the rake-out belt 8 with respect to the guide plates *7a* and *7b*, the inside diameter of the stacking cylinder 21, the positions of the packaging paper guide plates 30 with respect to the stacked coins, the distance between the crimping hooks 26 (or the height of the upper arm 32), and the position of the paper feeding device 28, so that all of these elements are suitably operated.

For this purpose, there is provided a denomination setting device which has a denomination selecting knob 40 employed as denomination selecting means and which is manually operated. This knob 40 is mounted on a rotary shaft 41 on which a thickness control cam K1, a rake-out belt setting cam K2, a coin path width setting cam K3, and a speed change cam K9 are mounted. One end of the rotary shaft 41 is coupled to a denomination-selection-output cam switch means 42 made up of, for instance, three cam switches 42A, 42B and 42C, which functions as an electrical denomination selection output means.

With this cam switch means 42, the number of denominations to be selected is $2^3(=8)$ in this embodiment. The knob 40 is marked with denomination scales $n_1, n_2 \ldots n_8$ at the periphery. A desired denomination is selected by setting a value on the respective denomination scale opposite an index 44, as a result of which a denomination selection output is delivered from the cam switch means 42.

Similarly as in the cam switch means 42, cam switch means 46 made up of three cam switches 46A - 46C is provided for obtaining a setting output from the above-described denomination selection output. This cam switch means 46 is coupled to one end of a rotary shaft 50 the other end of which is connected to the output shaft 47 of the paper feeding motor 76 through the cluth 48 and through a gear mechanism 49. When the shaft 50 is rotated by the paper feeding motor 76, an electrical setting output corresponding to an angular position of the shaft is produced by the cam switch means 46.

The outputs from the cam switch means 42 and 46 are applied to a coincidence detection circuit 52, which upon coincidence of these outputs, produces a coincidence output. The coincidence output thus produced is inputted to a main control circuit 53.

The main control circuit 53 controls the motors M1 - M6 and the clutches 48, 80 and 82 according to the coincidence output and the output of operation condition input means 75.

Thus, if, when the denomination selecting knob 40 is set to one denomination scale (for instance $n_1$), the angular position of the shaft 50 corresponds to another denomination scale (for instance, $n_4$), the setting output of the cam switch means 46 does not coincide with the denomination selection output of the cam switch means 42, and therefore no coincidence output is provided by the coincidence detection circuit 52. Accordingly, the clutch 48 is operated by the main control circuit 53, and the rotary shaft 50 is turned by the paper feeding motor 76 (M5) until a coincidence output is produced by the coincidence detection circuit 52. That is, the shaft 50 is positioned at its angular position corresponding to the denomination selected by the denomination selecting knob 40, whereupon a mechanical setting output having a magnitude corresponding to the angular position of the shaft 50 is obtained to set the various elements described above.

The thickness control cam K1 moves vertically and sets an adjuster 56 provided below the cam K1 with the aid of a cam plate 55 turned by a bevel gear 54 connected to the rotary shaft 41. Similarly, the rake-out belt setting cam K2 moves vertically and sets an adjuster 86 provided below the stand 85 of the rake-out belt 8 with the aid of a cam plate 84 turned by a bevel gear 57.

The coin path width setting cam K3 operates to turn a cam plate 89 in contact with the movable guide plate *7b* with the aid of a star-wheel engaging a crown gear 87 mounted on the rotary shaft 41, thereby to horizontally move and set the guide plate *7b* so that the width of the coin path corresponds to the diameter of the coins having the preselected denomination.

Thus, when coins having the same denomination as that preselected are introduced into the rotary disk 3, the thickness control plate 6 operates to positively arrange them in the coin path 4 one by one, and the rake-out belt 8 operates to rake the coins along the guide plates *7a* and *7b* with optimum abutting force. In the case when a coin having a denomination different from the preselected one is delivered to the rotary disk 3, if the coin is greater in thickness than a coin having the preselected denomination (hereinafter referred to as "a predetermined coin" when applicable) it is rejected by the thickness control plate 6; and if the diameter of the coin thus introduced is smaller than the predetermined coin (it is, in general, thinner than the predetermined coin), it drops through the gap between the guide plates *7a* and *7b*. Thus, even if coins different in denomination from the predetermined coins are put in the hopper 1, or even if coins of the predetermined denomination and other coins are put together in the hopper 1, the coins other than the coins of the predetermined denomination will not be packaged.

The cylinder diameter setting cam K4 operates to move and set a control lever 89 of the stacking cylinder 21 by the use of a cam plate 88 turned through a bevel gear 87 mounted on the rotary shaft 50. Therefore, even if a coin drops into the stacking cylinder 21 in such a manner that the surfaces of the coin are parallel with a vertical plane, it is horizontally placed therein because it is vibrated when dropped. Therefore, the coins dropped into the stacking cylinder 21 are positively stacked.

The roll position setting cam K5 operates to turn a lever 92 which supports the packaging roll 24 through a bevel gear 87 and a gear mechanicm 90 and 91 so that when a stack of coins is lowered into the space surrounded by the packaging rolls 24, there is a slight gap between the side surface of the stack of coins and the packaging rollers 24, that is, the first position of the packaging rollers 24 is set according to the outside diameter of the coin stack. Thus, the rolls 24 serve as guide walls for the coin stack when it is lowered by the guide rod 25 into the space surrounded by the rolls 24, and therefore the stack of coins can be kept in its proper form.

The guide roller setting cam K6 operates to determine the closure position of the packaging paper guide plates 30 according to the diameter of the coins of predetermined denomination so that the packaging paper 27 is positively wrapped around the stack of coins with the aid of the packaging rolls 24 when the packaging paper guide plates 30 have moved to the closure position. More specifically, similarly to the case of the cam K4, the guide roller setting cam K6 operates to turn with respect to the packaging roll 24 (on the left side in this embodiment) the packaging paper guide plate 95, which is provided for the packaging roll 24, through a link mechanism 94 with the aid of a cam plate 93 turned by the level gear 87 and the gear mechanism 90, and determines the direction of the guide plate 95 so that when the packaging rollers reach the first position, the inner surface of the guide plate 95 is substantially along the outside surface of the stack of coins.

The crimping hook setting cam K7 operates to position the upper shift arm 32 so that when the stack of coins is brought to the lowest level by the guide rod 25, the uppercrimping hook 26 is at a level higher than the height of the stack of coins which is determined by the total thickness of the coins having the preselected denomination. More specifically, the cam K7 operates to vertically swing a lever 97 with the aid of a cam plate 96 mounted on the rotary shaft 50, the lever 97 engaging the upper shift arm at its one end, as a result of which the arm 97 and a timing cam provided therefor are vertically moved and set.

Therefore, the crimping hooks 26 can positively fold and crimp the both lateral edge portions of the paper 27 wrapped around the stack of coins.

If the speeds of the rotary disk 3 and the rake-out belt 8 are maintained unchanged, when the coins arranged on the rotary disk 3 under the thickness control plate 6 are raked out, the number of coins raked out for a unitary period of time is reduced as the diameter of a coin is increased. Therefore, in order to stack a predetermined number of coins in the stacking cylinder 21 in the same period of time at all times regardless of the diameters of the coins, it is necessary to change the speeds of the above-described rotary disk 3 and belt 8. Furthermore, in the case when the packaging rollers 24 are rotatably in contact with the stack of coins to wrap the packaging paper around it, in order to complete the wrapping operation in the same period of time at all times it is necessary to keep the circumferential speed of the stack of coins unchanged regardless of the diameter thereof. For this purpose, a speed change mechanism is coupled through a speed change cam K8 to the drive output shaft 50 of the paper feeding device 28. Therefore, when the shaft 50 is turned in correspondence to the preselected monetary denomination, this operation is transmitted to the cam K8, whereby the speed of the packaging motor M6 is changed by the speed change mechanism.

Condition signals from a power switch, means for setting the number of coins, a start button, a stop button, and a clear button which will be described later, the above-described mode change-over switch, and the operation condition input means 75 are applied to the main control circuit 53, whereby the main control circuit 53 controls the whole operation of the coin packaging machine.

A speed change cam K9 comprises a high speed cam plate 98, a middle speed cam plate 99, and a low speed cam plate 100 which are fastened to the rotary shaft 50. Against these cam plates are engaged the operating levers of the speed change mechanism 67 provided for the packaging rolls 24 and the paper feeding rolls. The speed change cam K8 (not shown) is the same as the speed change cam K9.

Figure 3:
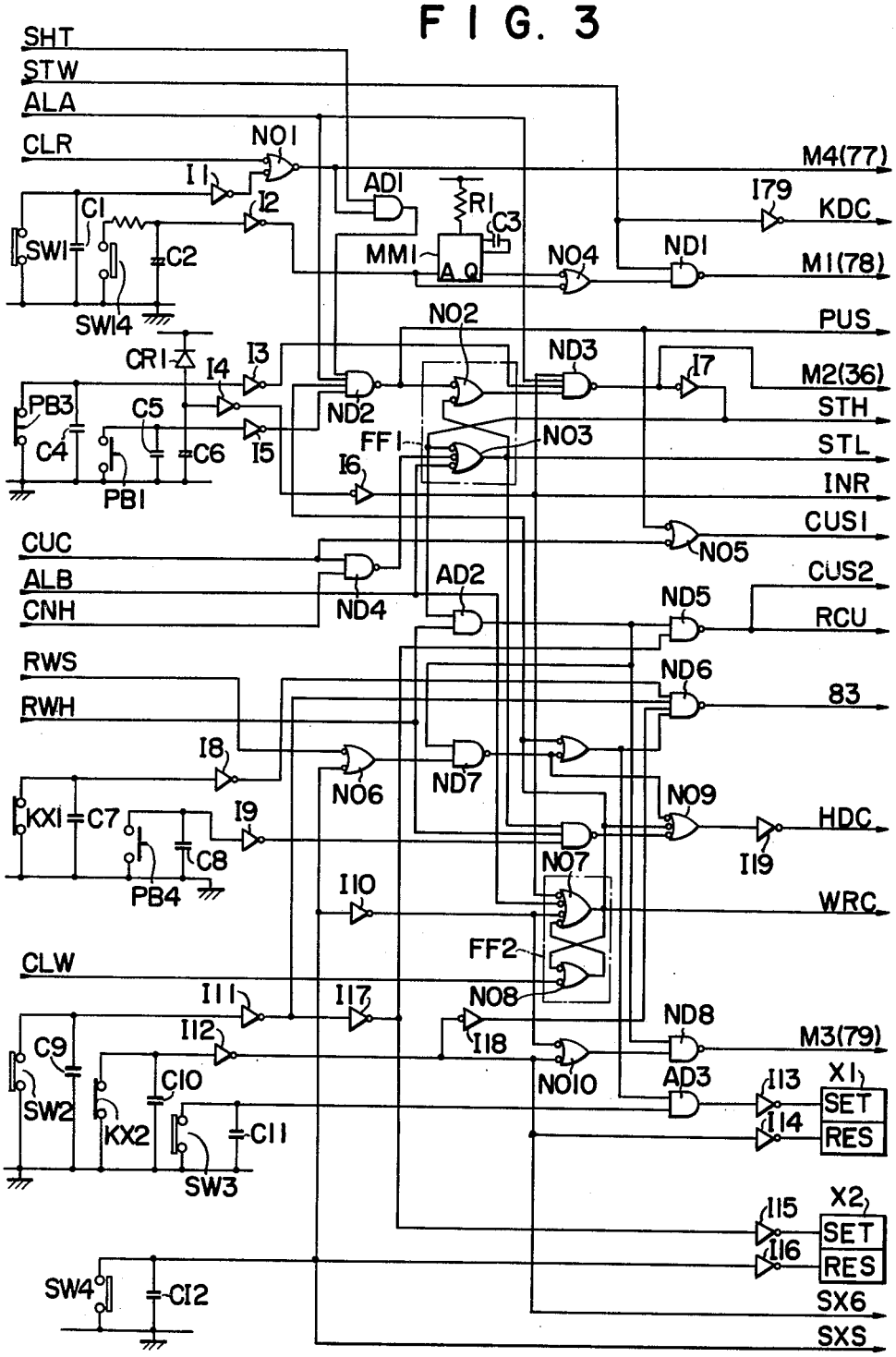
FIGS. 3, 4 and 5 are three parts of a circuit diagram showing the control system of the coin packaging machine.
Figure 4:
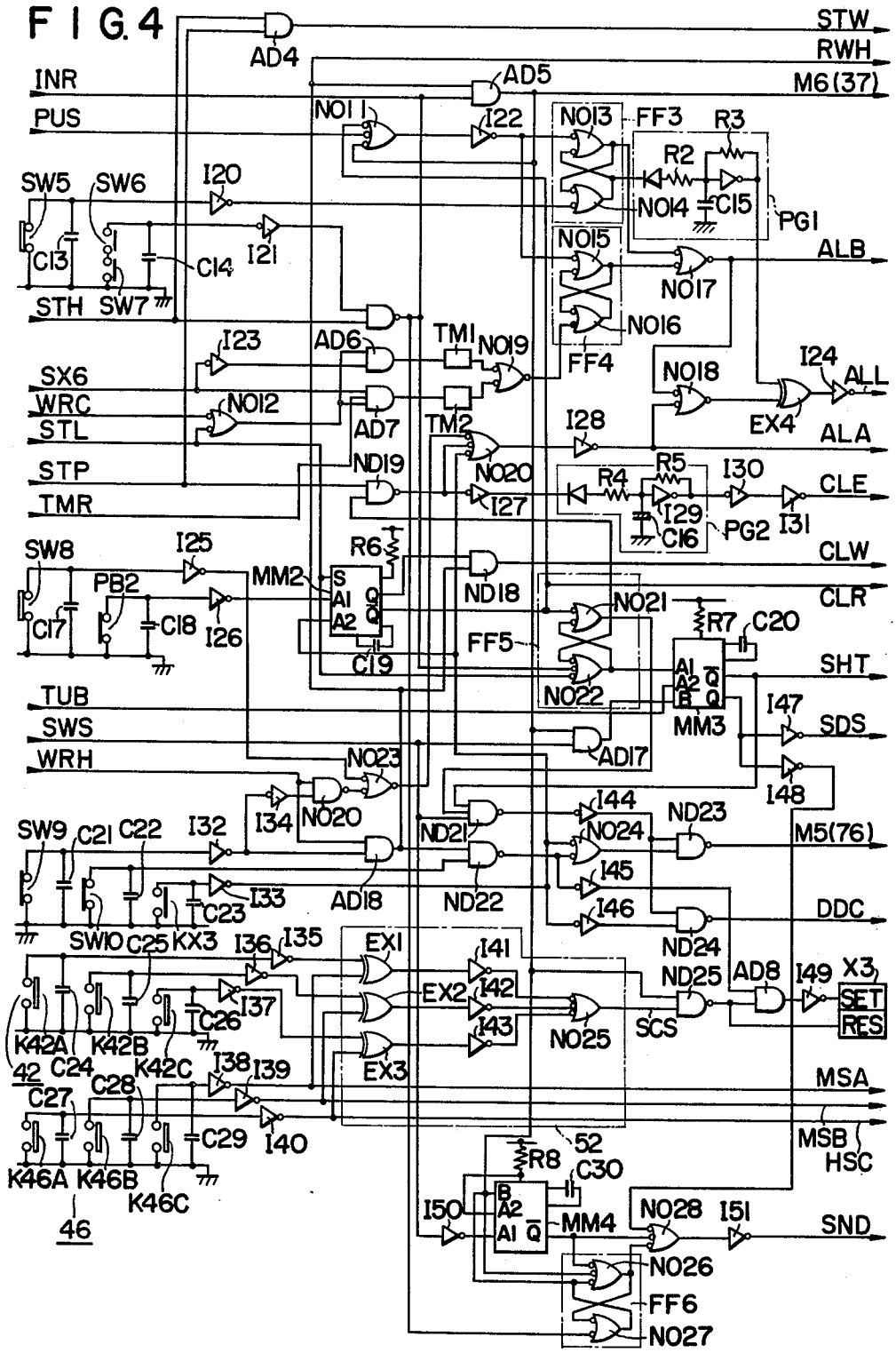
Figure 5:
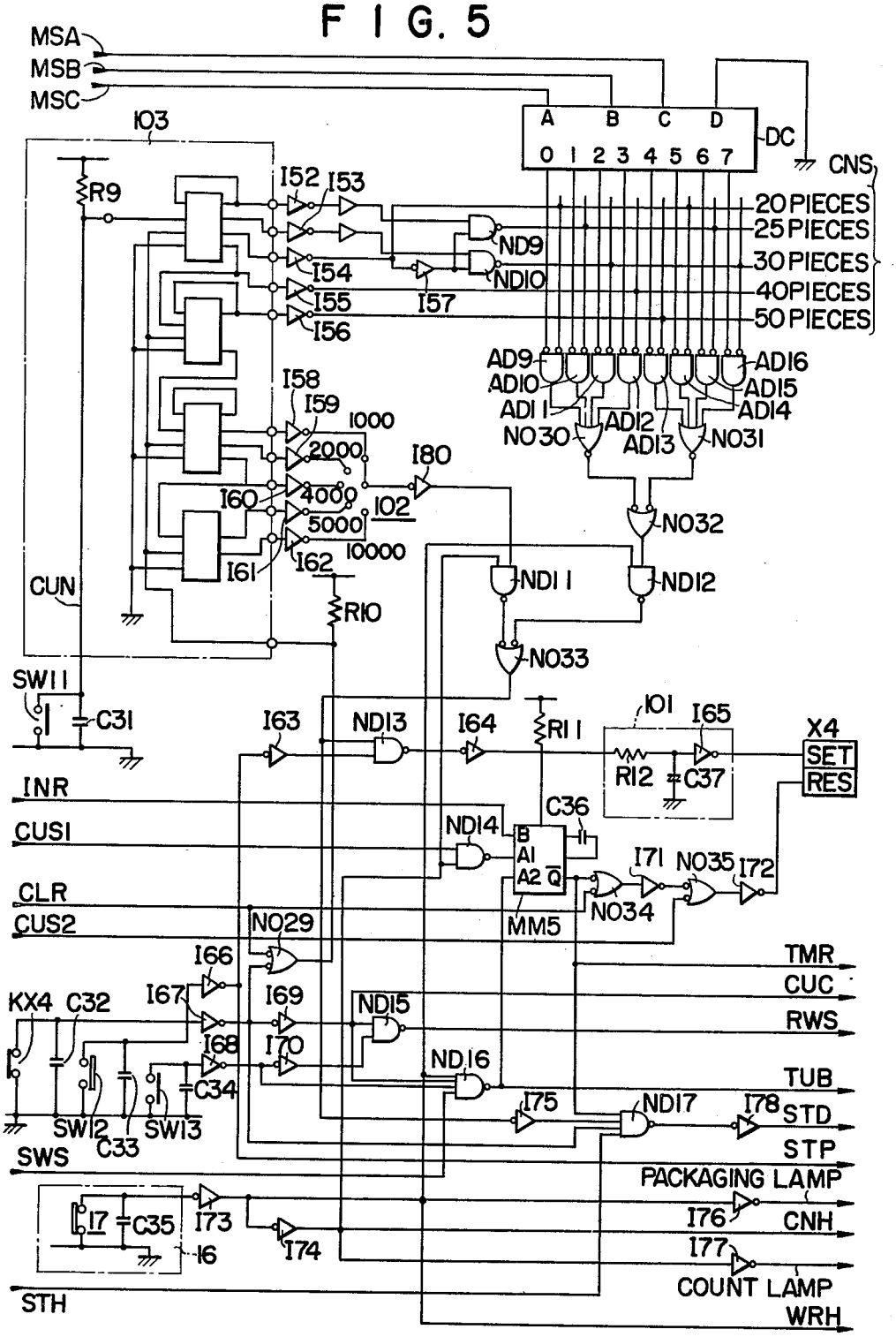
Figure 6:
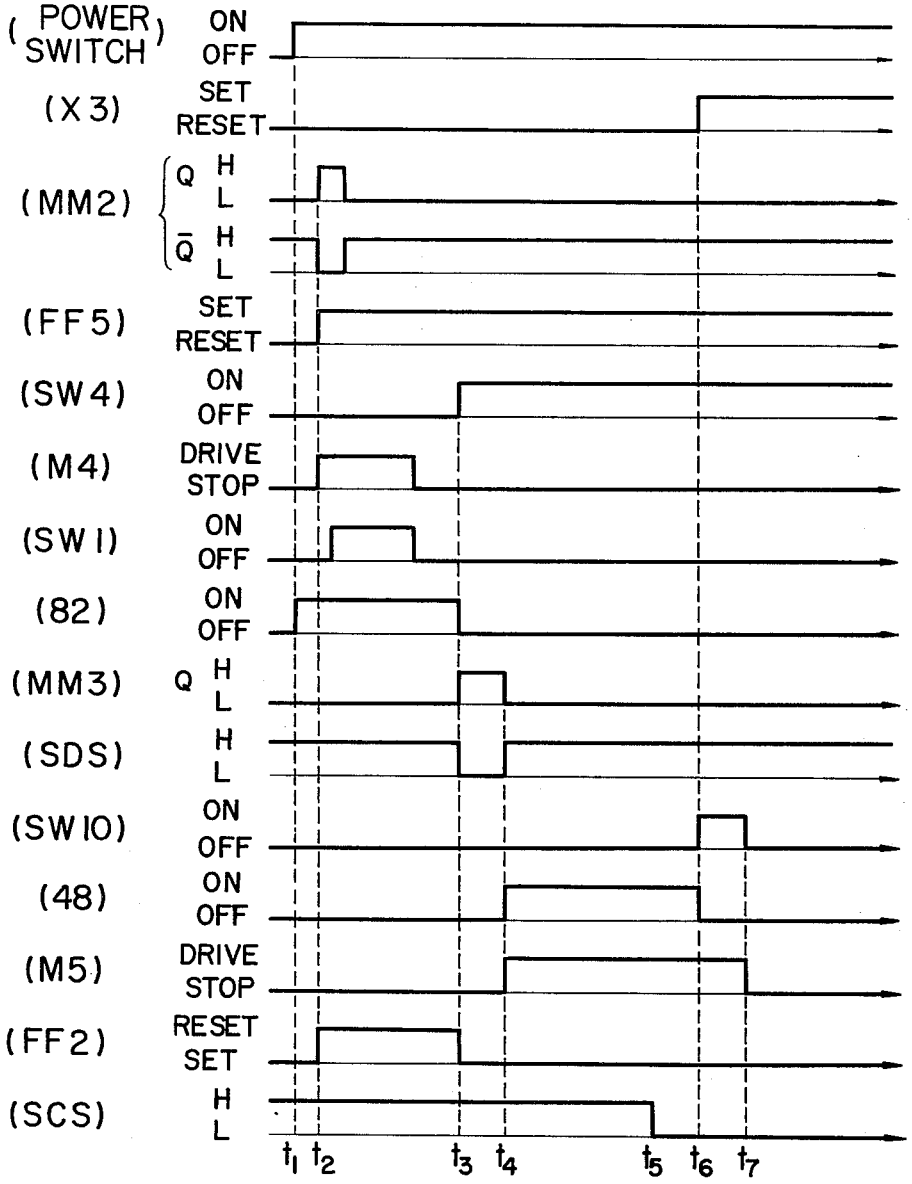
FIGS. 6 and 7 are time charts for a description of the control system.
Figure 7:
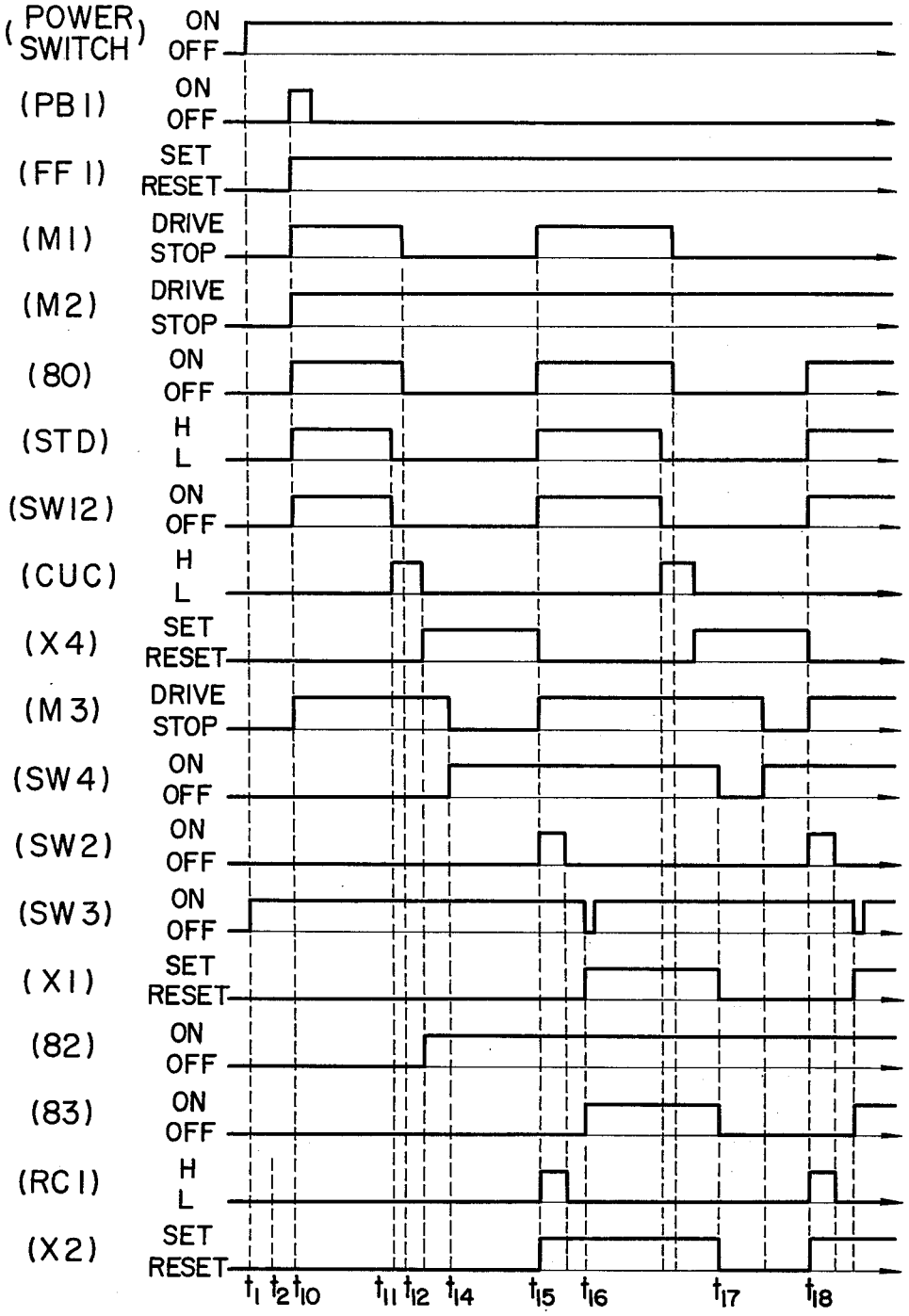

The control circuit of the coin packaging machine thus organized is illustrated in FIGS. 3, 4 and 5. The operation of the control circuit will be described in reference also to the time charts in FIGS. 6 and 7.

When the power switch of the coin packaging machine is turned on at the time instant $t_1$, an initial reset signal INR ("H" level) for resetting the initial conditions is formed by a diode CR1, a capacitor C6, and inverters 14 and 16, and at the time instant $t_2$ immediately after the power switch has been turned on a flip-flop FF2 is reset to produce a packaging clear signal WRC, while a flip-flop FF5 is set. On the other hand, the "Q" output of a mono-mutiplier MM2 is set at an "H" level, and the clear motor M4 is driven through a NAND circuit ND18 and a NOR circuit NO1, whereby the counter 13 is cleared. Furthermore, a mono-multivibrator MM5 is also cleared by the initial reset signal INR. While the initial reset signal INR is being produced, the packaging motor M6 is not driven through an AND circuit AD5. A mono-multivibrator MM1 is so designed that when the terminals B, A1 and A2 are at "H", "L" and "L" levels, respectively, the "Q" output is at an "H" level.

In FIGS. 3, 4 and 5, the contacts are in the standby states, having been initially reset, and normally opened contacts and normally closed contacts are indicated by marks . and ., respectively The motor M4 makes one revolution and stops by means of a one-revolution keep switch SW1.

When the mode change-over switch 17 is operated to provide the packaging mode, a packaging lamp is turned on through threshold detecting inverters I73 and I76. The mode change-over switch 17 is operated after the front door (not shown) of the coin packaging machine has been opened, but the front door must be kept closed for safety during the coin packing operation. If the front door is closed, a front door switch SW9 is kept on, and an "H" level signal is produced by a threshold detecting inverter I32. As the output (the packaging mode signal WRH) of the inverter I73 is at an "H" level, the output of an AND circuit AD18 becomes an "H" level signal, an "H" level signal is outputted through the AND circuit AD5, and the packaging motor M6 is driven. However, since the clutch 82 is set in the inoperative condition by a clutch drive signal HDC, no drive power is transmitted to the coin wrapping machine.

When the denomination selecting knob 40 is set to the denomination of coins to be packaged, the cam switches 42A – 42C of the cam switch means 42 are turned, and the outputs developed at the contacts K42A – K42C thereof are applied to EXCLUSIVE OR circuits EX1 – EX3 through inverters I35 – I37, respectively. At the same time, the outputs developed at the contacts K46A – K46C of the cam switches 46A – 46C of the cam switch means 46 connected to the rotary shaft 50 of the paper feeding circuit 28 are also applied to the EXCLUSIVE OR circuits EX1 – EX3 through inverters I38 – I40. According to the on-off positions of these contacts K42A – K42C and K46A – K46B, BCD signals corresponding to the denominations are provided. When the BCD signals from both cam switch means are coincident with each other, the level of the denomination coincidence signal SCS becomes an "L" level through inverters I41 - I43 and a NOR circuit NO25. In this connection, the outputs of the contacts K46A - K46C are applied to a decoder DC adapted to convert a BCD code into a decimal code.

When the output of the cam switch means 42 is not coincident with that of the cam switch means 46, that is, the selected denomination is not equal to the set output denomination, the level of the denomination coincidence signal SCS is at the "H" level, and a keep relay X3 is reset through a NAND circuit ND24. Thus, the relay contact means KX3 assumes its "off" position, and the output level of an inverter I33 becomes an "L" level. This "L" level output signal is applied to the NOR circuit NO24, the "H" level output of which is applied to one input terminal of a NAND circuit ND23. Since the packaging section is at a predetermined position, a switch SW4 for detecting that the packaging section is at its predetermined position is off, a predetermined position switch signal SWS of an "L" level is applied to an AND circuit AD17, NAND circuits 21 and ND16, and an inverter I50.

As an "L" level signal is applied through the inverter I33 to the terminal A2 of the mono-multivibrator MM2, a pulse having a predetermined pulse width is provided at the "Q" terminal thereof and is inputted to a NAND circuit 18. On the other hand, as an "H" level signal is produced by a NAND circuit ND9, a clear signal CLW (L) is produced through the NAND circuit ND 24.

On the other hand, as the level of the "Q" output of the mono-multivibrator MM2 becomes an "L" level, the flip-flop FF5 is reset to store the clear signal CLW, and this set output is applied to the NAND circuit ND21. The output of a NOR circuit NO22 constituting the flip-flop FF5 is fed to the terminal A1 of a mono-multivibrator MM3, through the "Q" terminal of which a pulse with a predetermined pulse width is produced. Thus, a shutter opening signal SDS(L) is provided through an inverter I47, and therefore the shutter 22 is opened for the predetermined pulse width ($t_3$). At the same time, the output of the mono-multiplier MM3 is applied through an inverter I48 to a NOR circuit NO28, and a solenoid drive signal SND is provided through an inverter I51. By this solenoid drive signal SND, a solenoid (not shown) disposed at the coin package discharging outlet 34 is driven so that the coin package is taken out and the unnecessary coins in the stacking cylinder 21 are rejected and discharged into a suitable container. This operation will be described later.

After the pulse with the predetermined pulse width has been produced through the terminal $\overline{Q}$ of the mono-multivibrator MM3, the level of the shutter opening signal SDS is raised to an "H" level ($t_4$), and is applied to the NAND circuit ND21. Therefore, the output level of the NAND circuit ND21 becomes an "L" level. This "L" level signal is applied through an inverter I44 to the NAND circuits ND23 and ND24, and "L" level signals are produced therefrom. Thus, the clutch 28 is operated, and the paper feeding motor M5 is driven, to move the paper feeding device 28.

As a result, the paper feeding device 28 is set at the position corresponding to the preselected denomination, the level of the denomination coincidence signal SCS becomes an "L" level ($t_5$), and the NAND circuit ND25 provides an "H" level output. At this time, a detection switch SW10 for detecting the predetermined position of the paper feeding device is turned on, the input level of the NAND circuit ND22 is raised to an "H" level, and an "H" level signal is outputted through the NOR circuit NO24 and the NAND circuit 23. The paper feeding device 28 is disconnected from the motor M5 by means of the clutch 48, but it is continuously turned by inertia for a while.

When the switch SW10 is turned off, an "L" level signal is outputted from the NAND ND22, and an "H" level signal is applied to an AND circuit AD8 through an inverter I45. In this case, since the denomination selected by the knob 40 is coincident with the denomination relating to the paper feeding device and so forth, the AND circuit AD8 produces an "H" level signal by receiving an "H" level signal from a NAND circuit ND25, and the keep relay X3 is reset. Thus, the relay contact means KX3 is set "on", and the level of the clutch drive signal DDC is raised to an "H" level through the inverter I33, an inverter I46, and the NAND circuit ND24, to stop the paper feeding device 28 and so forth ($t_7$).

Then, a start button PB1 is depressed ($t_{10}$). Therefore, an "H" level signal is applied through a threshold detecting inverter I5 to a NAND circuit ND2, whereby a flip-flop 1 is reset to store the start instruction. When the flip-flop 1 has been reset, an "H" level signal is produced by a HOR circuit NO2, and the level of a start signal STH is changed to an "H" level through a NAND circuit ND3 and an inverter I7. On the other hand, the rotary disk motor M2 is driven from the output of the NAND circuit ND3.

As a stop plate for mechanically stopping the starwheel has not been dropped into the groove thereof, a stop switch is in the "off" state, and the level of the output STW of an AND circuit AD4 is raised to an "H" level through an inverter 66. This output is applied to a NAND circuit ND1 and an inverter I79. By the output of the inverter I79, namely, a clutch drive signal KDC, the clutch 80 is operated, and the coin feeding motor M1 is driven from the output of the NAND circuit ND1 ($t_{10}$).

A level switch SW14 for controlling the supply of coins to the rotary disk 3 from the hopper 1 is provided in the rotary disk 3. When this switch SW14 detects an excessive supply of coins, the contact means thereof is closed, and the mono-multivibrator MM1 is triggered. Thus, an "L" level signal is produced from a NOR circuit NO4 with a delay of a predetermined time. Therefore, an "H" level signal is provided by the NAND circuit ND1, and the driving of the rotary disk motor M1 is suspended ($t_{12}$).

As the packaging section is in the standby state at its predetermined position, the switch SW4 is in the "off" state, and an "L" level signal from an inverter I10 is applied to a NAND circuit ND8 through a NOR circuit N010. On the other hand, the level of the output of an AND circuit AD2 is raised to an "H" level with the aid of the "H" level output of the AND circuit AD9 and the start signal STH from the inverter I7, and is then applied to a NAND circuit ND8. By the "H" level output of the NAND circuit ND8 the vibrating motor M3 is driven ($t_{10}$).

As was described, the coins are arranged along the peripheral part of the rotary disk by centrifugal force, and are conveyed to the packaging section by the conveying mechanism one by one, and are stacked in the stacking cylinder. During this conveying operation, the coins, being conveyed by the star-wheel 12, are mechanically counted, and the number thereof is counted and displayed by the counter 13. On the other hand, a count switch SW11 is provided which is turned on whenever the star-wheel 12 has made five revolutions, or five coins have been conveyed. A detection signal CUN produced by the count switch SW11 is counted by an electronic counter 103. The count value of the electronic counter 103 is converted into signals CNS representative of 20, 25, 30, 40 and 50 individual coins (hereinafter referred to as "a coin number signal CNS", when applicable) by inverters I52 to I57 and NAND circuits ND9 and ND10. The counter 103 is so designed that when a denomination is selected by the knob 40, it is cleared through a NOR circuit NO29 by the "Q" output of the mono-multivibrator MM2.

The output terminals "0", "1", "2" . . . "7" of the decoder DC are provided in correspondence to monetary denominations, respectively. For instance, the output terminals "0", "1", and "4" are provided for monetary denominations 1 yen, 5 yen, and 100 yen, respectively. The setting of the knob 40 to "100 yen coin" causes the output terminal "4" to have an "L" level, and the other output terminals "0" - "3", and "5" - "7" to have "H" levels.

As the number of 100 yen coins conveyed is counted by the counter 103 and the coin number signals CNS representative of 20 coins - 40 coins are produced, "L" level signals are provided, but none of the two inputs of each of AND circuits AD9 - AD12, and AD14 - AD15 become "L" levels, at the same time. However, when the output of the inverter I56 is lowered to an "L" level, or fifty coins are detected, both inputs of an AND circuit AD13 become "L" levels, and an "H" level signal is applied to NAND circuit ND12 through NOR circuits NO31 and NO32. Since an "H" level signal corresponding to the packaging mode has been applied to the other input of the NAND circuit ND12 by the mode change-over switch 17, therefore the output level of the NAND circuit ND12 becomes an "L" level.

Thus, an "H" level signal is produced by a NOR circuit NO33, and the level of a stopper plate drive signal STD becomes an "L" level through an inverter I75, a NAND circuit ND17, and an inverter I78 ($t_{11}$). As a result, the stopper plate is dropped into the groove of the star-wheel 12, and the coin conveying operation of the conveying mechanism is temporarily suspended.

At this time, a stop plate switch SW12 is turned off, and an "L" level signal is applied to a NAND circuit ND13 through inverters I66 and I63, and a keep relay X4 is set through an inverter I64 and a delay circuit 101. Thus, the relay contact mean KX4 is turned off, and an "L" level signal is produced from an inverter I67, whereby a counter 100 is cleared through a NOR circuit NO29 ($t_{13}$).

In this operation, an "L" level signal is applied to an inverter I69 also, and an "H" level signal is applied to one input of a NAND circuit ND15. In this connection, in the case where no "coin-standing" (described later) occurs in the stacking cylinder 21, a coin-standing detection switch SW13 is off, and an "H" signal is applied to the other input of the NAND circuit ND15 through inverters I68 and I70. As a result, an "L" level packaging start signal RWS is produced by the NAND circuit ND15.

This packaging start signal RWS is inputted to a NOR circuit NO6, the level of the clutch drive signal HDC is changed to an "L" level to operate the clutch 82, and the drive power of the packaging motor M6 is transmitted to the packaging section to start the coin packaging operation.

Upon transmission of the drive power to the packaging section, the switch SW4 is turned on ($t_{14}$), and an "L" level signal is applied to the NOR circuit NO6, whereby the packaging section is maintained in the driven state by the packaging start signal RWS.

An automatic count start switch SW2 is turned on ($t_{15}$), and an "H" level signal is provided by an inverter I11. This "H" level signal is applied through inverters I17 and I15 to a keep relay X2 to set the latter.

The "H" level signal from the inverter I17 is applied to a NAND circuit ND5 also, and the "L" level output of the NAND circuit ND5 is counted, as the number of rolls of coins, by a roll counter.

When the coins have been made ready to be wrapped in the packaging section, the packaging paper 27 is cut into a predetermined length by a cutter. In this operation, a paper-cutting detection switch SW3 is turned off ($t_{16}$), and a keep relay X1 is set through an AND circuit AD3 and an inverter I13. Therefore, the relay contact means KX1 is turned on, and the packaging control device 83 is driven through an inverter I8 and a NAND circuit ND6. When the stack of coins has been wrapped with the paper, or the wrapping operation has been completed, the switch SW4 is turned off, and the keep relay X2 is reset ($t_{17}$). Therefore, the relay contact means KX2 is turned on, and the keep relay X1 is also reset through inverters I12 and I14 ($t_{17}$).

When the coins have been counted, an "L" level signal is applied to a NOR circuit NO35, and the keep relay X4 is reset through an inverter I72 ($t_{18}$).

In this connection, since the shutter 22 has been closed, the automatic count start switch SW2 is turned on. As a result, the above-described counting operation and packaging operation are carried out again.

Now, the case where the change-over mechanism 16 is changed over to the count mode, or the mode change-over switch 17 is turned off, will be described.

In this case, a count mode signal CNH is provided through inverters I73 and I74, and is applied to a NAND circuit ND4, while a count lamp is turned on by the output of an inverter I77. Then, the front door of the coin packaging machine is opened, a box (or a bag) for receiving the counted coins is provided at a counted coin discharge outlet section 19. In this case, the front door is kept open, and the front door switch SW9 is off.

Then, a knob 102 for setting the number of coins is set to a preselected number (in this example, five total numbers of coins, that is, 1,000, 2,000, 4,000, 5,000 and 10,000 coins being provided).

It is assumed that the knob 102 is set to "1,000 coins". In this case, the output of an inverter I58 is applied to a NAND circuit ND11 through an inverter I80.

If the start button PB1 is depressed, similarly as in the case of the above-described packaging mode, coins are conveyed to the packaging section. The number of coins is mechanically counted and displayed by the counter 13, and is further counted through the count switch SW11 by the counter 103. When 1,000 coins have been counted by the counter 103, an "L" level signal is provided from the inverter I58, and an "H" level signal is introduced into the NAND circuit ND11 through the inverter I80. Therefore, the NAND circuit ND11 produces an "L" level signal, and the level of the output of the NOR circuit NO33 is raised to an "H" level. Accordingly, the level of the output of the NAND circuit ND13 is changed to an "L" level, and the keep relay X4 is set through the inverter I64 and the delay circuit 101. Thus, the relay contact means KX4 is turned on, and a count completion signal CUC is provided through the inverters I67 and I69. This signal CUC is applied through a NAND circuit ND4 to the flip-flop FF1 to reset the latter. Thus, the coin counting operation is completed.

Incidentally, if, while coins are being stacked in the stacking cylinder with the vibrating mechanism operated, coin-standing is detected, the coin-standing detection switch SW13 is turned on. The term "coin-standing" herein used is intended to mean that a coin stands upright and is not stacked flat in the stacking cylinder 21 (hereinafter referred to as "a standing coin" when applicable). This coin-standing can be detected by utilizing the conductivity of coins.

The detection of such coin standing is carried out after coins have been stacked in the stacking cylinder. More specifically, this detection is carried out after the precedingly-stacked-coins packaging operation has been completed by the packaging means made up of the packaging rolls 24 and the crimping hooks 26. If coin standing is detected, the coins currently stacked in the stacking cylinder 21X are not wrapped by the packaging means, so that the stack of coins including the standing coin is rejected. In the coin packaging operation, the period of time required for stacking coins in the stacking cylinder is shorter than that required for packaging stacked coins by the packaging means. Therefore, even if coin standing is detected so as to provide a detection output when the stacking of coins have been completed, this detection output is disregarded or made ineffective, and the cylinder is continuously vibrated to eliminate the coin standing conditions until the packaging operation being carried out on the preceding stack is ended, so that coin standing is detected with respect to the state of stacked coins at the time the preceding packaging operation has been completed.

When a coin standing is detected by a coin standing detection means 58, and the switch SW13 is thus turned on, an "L" level signal is applied to a NAND circuit ND15 through inverter I68 and I70, and therefore no packaging start signal RWS is produced by the NAND circuit ND15. On the other hand, an "H" level signal from the inverter I68 is applied to a NAND circuit ND16, from which a coin-standing signal TUB is produced under the conditions of the packaging mode, and so forth. This coin-standing signal TUB is applied to the terminal A2 of the mono-multivibrator MM4, from the terminal Q of which an "L" level signal is provided, whereby the keep relay X4 is reset.

The coin-standing signal TUB is applied to the terminal A2 of the mono-multivibrator MM3 also. Based on the output provided at the terminal Q of the mono-multivibrator MM3, the shutter opening signal SDS is produced to open the shutter 22. This "Q" output of the mono-multiplier MM3 is applied to the NOR circuit NO28 through the inverter I48, and the solenoid drive signal SND is produced from the inverter I51 to drive a solenoid (not shown) arranged at the outlet 34.

As a result, a change-over means 111 is operated so that the group of coins including the standing coin is rejected and discharged into a container 110 separately provided.

Then, when the shutter 22 is closed, the automatic count start switch SW2 is turned off to issue an automatic count start command.

On the other hand, detection switches SW6 and SW7 are provided with respect to the arms 32 described before, so as to detect the number of coins to be packaged in response to the vertical movement of the arms 32. If the number of stacked coins is more than the predetermined number of coins of a preselected denomination, the distance between the arms 32 is longer than a predetermined distance; while if the number of stacked coins is less, the distance is shorter. The on-off operations of the switches SW6 and SW7 are controlled by this change of the distance between the arms 32, and therefore it can be detected whether or not the number of coins is acceptable.

One example of means 59 for detecting whether or not the number of coins is acceptable will be described with reference to FIGS. 9 and 10.

Figure 9:
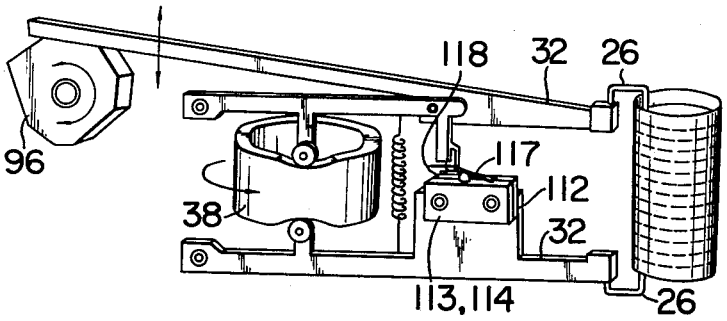
Figure 10:
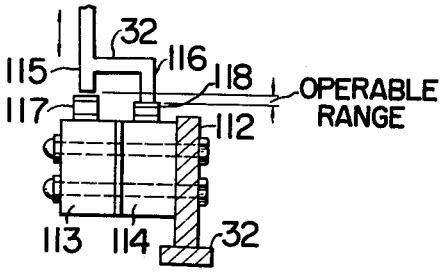

As is shown in FIGS. 9 and 10, the lower arm 32 is provided with a switch mounting plate 112 on which microswitches 113 and 114 are mounted, while the upper arm 32 is provided with depression plates 115 and 116 having different levels (like a stair) in correspondence to the depression knobs 117 and 118 of the microswitches 113 and 114 in such a manner that the contacts SW6 and SW7 of the microswitches 113 and 114 are both turned on (or closed) when depression plates 115 and 116 are in an operable range indicated in FIG. 10. More specifically, if the upper arm 32 is above the operable range, the microswitch 114 is turned off (opened), and if it is below the operable range, the microswitch 113 is turned off. In the case when another denomination has been specified, the distance between the two arms 32 is changed by a cam plate 96, and furthermore the operable range is also changed according to a selected denomination.

Thus, whenever the number of coins is more or less than the predetermined number, both of the switches SW6 and SW7 are turned on, and an "H" level signal is produced through the inverter 21 to set the flip-flop FF6. As a result, the solenoid drive signal SND is produced. Thus, a roll of coins the number of which is more or less than the predetermined number is rejected and discharged into the container similarly as in the above-described case.

A stop push button switch PB is provided so that whenever trouble occurs during the operation in the count mode or in the packaging mode, all of the mechanisms of the coin packaging machine can be stopped by depressing it. A manual push button switch PB4 is provided to carry out the inching operation of the packaging section. A clear push button switch PB2 is employed to restore the entire machine to its standby conditions.

An alarm signal ALA is produced in the cases where (1) the coin guide cover is opened (2) the front door is opened during a coin packaging operation, (3) the count section is not at its standby position although the clear operation has been conducted, and (4) denominations are not coincident in the packaging mode. Another alarm signal ALB is produced in the cases where the packaging section is over-loaded, (2) an excess or shortage of the number of coins is detected when both lateral edge portions of the paper have been crimped, and (3) a period of time required for packaging a stack of coins has exceeded a predetermined period of time.

Figure 8:
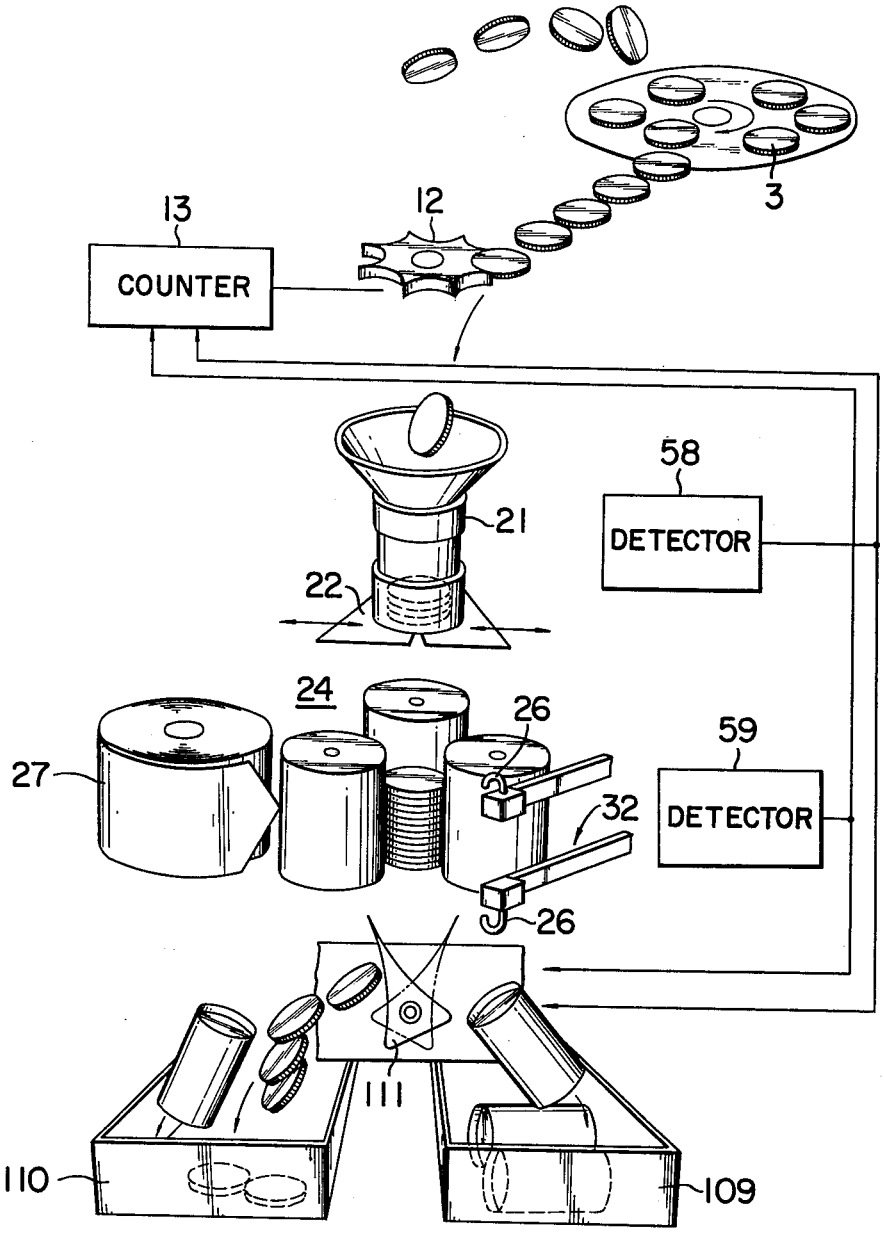
FIGS. 8, 9 and 10 are explanatory diagrams for a description of parts of the mechanism of the coin packaging machine.
Figure 11:
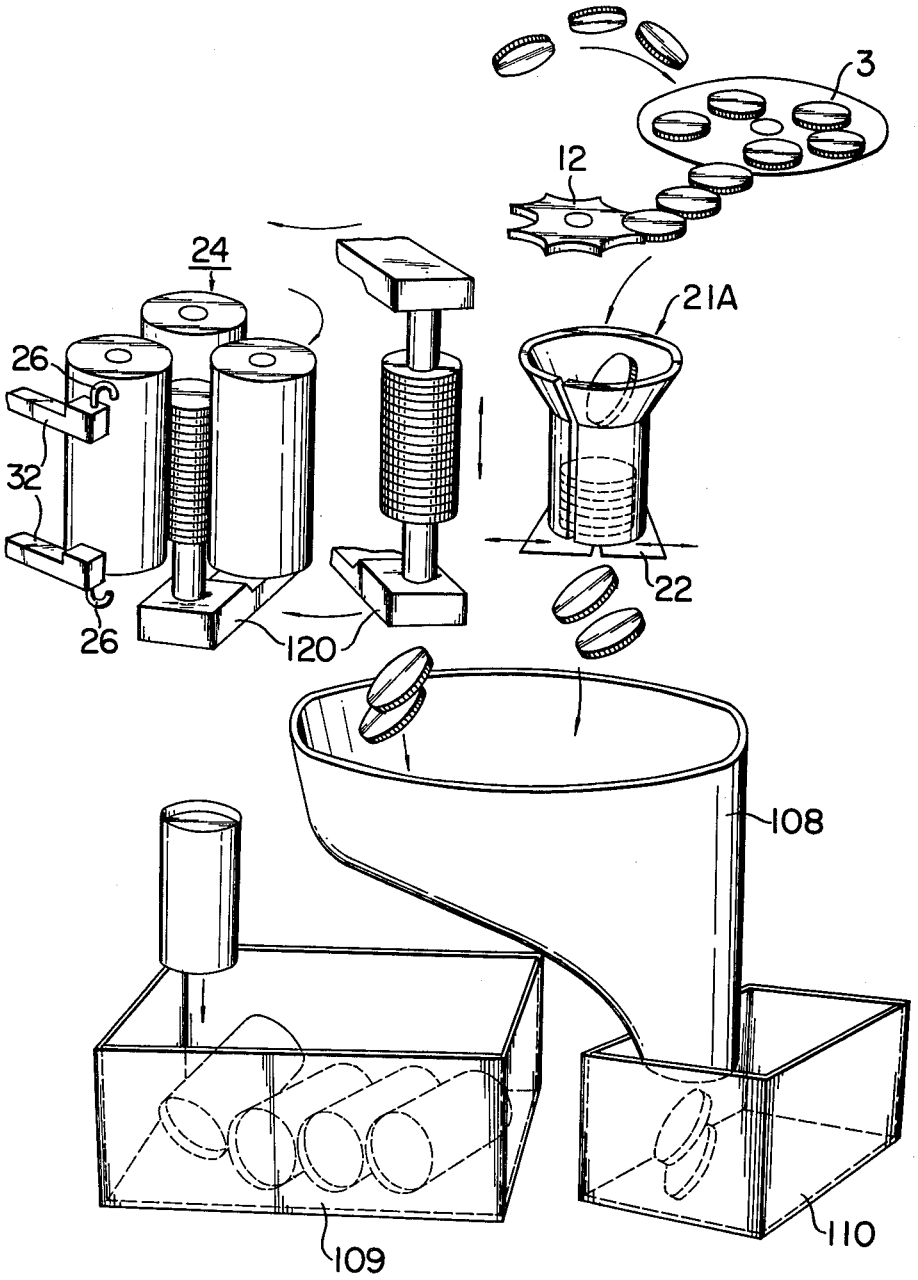
FIG. 11 is also an explanatory diagram for illustrating another example of the invention.

In the above-described example, as shown in FIGS. 1, 2 and 8, a shutter 22 is provided beneath the stacking cylinder 21. The stack of coins in the stacking cylinder 21 is dropped with the aid of the operation of the shutter to a coin packaging position, where the stack of coins is packaged and is subjected to a detection as to whether the number of coins in the stack is more or less than the predetermined number. Furthermore, the stacking cylinder 21 may be so designed that it can be vertically divided into two parts as the stacking cylinder 21 shown in FIG. 11. That is, in this case, when the two parts of the stacking cylinder are moved apart from each other, the stack of coins is held between two arms of a sandwiching and carrying means 120, and is carried over to a coin packaging position thereby, where the stack of coins is packaged and is then dropped into a container 109 provided below the coin packaging position.

In the case when a coin standing in the stacking cylinder 21A has been detected, the shutter 22 is opened so that the stack of coins including the standing coin is dropped into another container 110 through a coin rejection duct 108. The sandwiching and carrying means 120 is provided with the above-described detection means for detecting whether the number of coins is more or less than the predetermined number. Upon detection of the excess or shortage in the number of coins, the operation of the sandwiching and carrying means 120 is released to drop the stack of coins thus detected into the coin rejection duct 108. Thus, the packaging operation with the rejection of the stacks of coins including standing coins can be carried out.

As is clear from the above description, in the coin packaging machine according to the invention, even if a packaging error occurs, the packaging operation is not discontinued, and the following packaging operations are automatically started.

I claim:

1. A coin packaging machine for repeatedly packaging a predetermined number of coins separated according to denominations thereof, which comprises:

a. coin feeding means for feeding coins to be packaged;

b. coin counting means for counting the number of coins fed by said coin feeding means and for producing, when the number of coins counted coincides with a predetermined number, a coincidence signal;

c. coin stacking means for temporarily stacking coins fed by said coin feeding means until the coincidence signal is produced;

d. coin packaging means for packaging a stack of coins with packaging paper; and e. control means for controlling said coin feeding means, coin counting means, coin stacking means and coin packaging means, said control means including:

1. abnormality detecting means for detecting whether the conditions of a stack of coins temporarily stacked in said coin stacking means is normal or abnormal when said coin packaging means is at a predetermined position prior to the start of packaging of the temporarily stacked coins;

2. coin rejecting means for, rejecting, when the state of the stack of coins temporarily stacked in said coin stacking means is detected as being abnormal by said abnormality detecting means, said coins in said coin stacking means; and 3. restart commanding means for operating said coin counting means again after said coin rejecting means has operated, whereby whenever coins are stacked in an abnormal state in the coin stacking means, these coins are rejected from said coin stacking means, and the following packaging operation is automatically started.

2. A machine as claimed in claim 1, which further comprises packaging error detecting means for detecting a packaging error which may be caused in packaging the stacked coins.

3. A machine as claimed in claim 1, which further comprises detection means for detecting the height of coins stacked in said coin stacking means and for determining whether or not the height thus detected is in an allowable range predetermined separately according to the denomination of the coins being packaged.

* * * * *

UNITED STATES PATENT OFFICE
CERTIFICATE OF CORRECTION

Patent No. 4,058,954 Dated November 22, 1977

Inventor(s) Kazuto Asami

It is certified that error appears in the above-identified patent and that said Letters Patent are hereby corrected as shown below:

In the Heading, please insert:

-- [30] Foreign Application Priority Data:
October 9, 1975 - Japan 50-121921 --.

Signed and Sealed this
Fourth Day of April 1978

[SEAL]

*Attest:*

RUTH C. MASON
*Attesting Officer*

LUTRELLE F. PARKER
*Acting Commissioner of Patents and Trademarks*